US005319809A

United States Patent [19]

Testa

[11] Patent Number: 5,319,809

[45] Date of Patent: Jun. 14, 1994

[54] DUAL MODE FLUSH MECHANISM FOR TOILETS

[76] Inventor: Ernest J. Testa, 2250-69 N. Broadway, Escondido, Calif. 92026

[21] Appl. No.: 67,423

[22] Filed: May 25, 1993

[51] Int. Cl.[5] ..... E03D 1/14

[52] U.S. Cl. ..... 4/325; 4/324; 4/415; 4/405

[58] Field of Search ..... 4/324, 325, 405, 411, 4/412, 413, 414, 415, 345; 251/233, 279

[56] References Cited

U.S. PATENT DOCUMENTS

| | | | |
|---|---|---|---|
| 1,066,863 | 7/1913 | Theleen | 4/405 |
| 1,092,586 | 4/1914 | Meaker | 4/405 |
| 1,394,862 | 10/1921 | Reno | 4/405 |
| 2,744,261 | 5/1956 | Gram | 4/325 |
| 3,141,177 | 7/1964 | Kertell | 4/53 |
| 3,186,007 | 6/1965 | Falotico | 4/37 |
| 3,538,519 | 11/1970 | Weisz | 4/67 |
| 3,885,253 | 5/1975 | Overby | 4/67 A |
| 4,000,526 | 1/1977 | Biela | 4/57 P |
| 4,328,596 | 5/1982 | Renz | 4/324 |
| 4,406,024 | 9/1983 | Chiu et al. | 4/325 |
| 4,485,501 | 12/1984 | Klonek | 4/324 |
| 4,651,359 | 3/1987 | Battle | 4/324 |
| 4,748,699 | 6/1988 | Stevens | 4/324 |
| 4,764,995 | 8/1988 | Harney | 4/325 |
| 4,817,216 | 4/1989 | Auman | 4/325 |
| 4,881,279 | 11/1989 | Harney | 4/325 |
| 4,937,895 | 7/1990 | Stevens | 4/324 |
| 4,969,218 | 11/1990 | Comparetti | 4/324 |
| 5,243,713 | 9/1993 | More . | |

*Primary Examiner*—Henry J. Recla
*Assistant Examiner*—Gregory M. Vidovich

[57] ABSTRACT

An improved dual mode flush mechanism which provides the selection of either a full flush or a partial flush mode, by manipulating one flush control handle. A full flush is obtained by pushing the handle downward, in the conventional manner, which rotates an actuating lever upward to engage and lift a flush valve lift arm to fully open the flush valve. A partial flush is obtained by lifting the flush handle upward, which rotates the actuating lever downward engaging and rotating one end of a double cam downward, causing the opposite end to pivot upward, which engages and lifts the flush valve lift arm, to a limiting stop position, to partially open the flush valve. Releasing the flush handle causes the flush valve to immediately close, allowing a minimum amount of flushing water for light liquid waste. The flush handle can be held upward against the stop position for a longer time, to allow more flushing water as may be required for darker liquid waste, while still using less water than a full flush. Therefore, the user is not limited to only a preset amount of water for the liquid waste flushing, instead a very minimum amount of water, as allowed by adjustment of the limiting stop, can be used, or more water can easily be selected as the user determines to be necessary.

9 Claims, 4 Drawing Sheets

DUAL MODE FLUSH MECHANISM FOR TOILETS

BACKGROUND—FIELD OF INVENTION

This invention relates to dual flush mechanisms for toilets, specially, a dual flush mechanism which utilizes a single flush handle, a single float and a single flush valve in its construction.

BACKGROUND—DESCRIPTION OF PRIOR ART

Numerous prior art dual or selective flush toilet apparatus have been developed to conserve water. Generally by providing a partial flush of water for liquid waste, and a full flush for solid waste.

Complex designs have been made using multiple handles, multiple floats, multiple valves, gear racks, pulleys, air pressure and many other alternative methods to obtain a flushing action using lesser amounts of water.

Many of the prior art methods are costly to manufacture and complicated for the average user to install.

For example, U.S. Pat. No. 4,881,279 to Harney (1989) shows a dual flush system using a secondary handle and a secondary float. Actuating the secondary handle results in a partial flush with a fixed amount of water as controlled by the secondary float. While this design may perform its purpose, it is relatively expensive to manufacture and difficult for the user to install.

U.S. Pat. No. 4,748,699 to Stevens (1988) shows a dual flush system using a complicated arrangement of multiple floats, and adjustments, to obtain a partial flush with a fixed amount of water. This system is expensive to manufacture and difficult to install.

U.S. Pat. No. 4,969,218 to Comparetti (1990) shows a dual flush design with a complicated system of multiple floats, cords and adjustments resulting in a fixed amount of water for a partial flush. This system is expensive to manufacture and difficult to install.

OBJECTS AND ADVANTAGES

Accordingly, several objects and advantages of my invention are:

(a) to provide a flush mechanism which will conserve water by having an efficient partial flush mode, (b) to provide a flush mechanism which is low in cost to manufacture, (c) to provide a flush mechanism which has a single flush handle selectively operable for either a full flush or partial flush mode, (d) to provide a flush mechanism which does not require secondary flush valves or secondary floats in addition to those normally in conventional toilets, (e) to provide a flush mechanism which is not limited to a preset fixed amount of water for the partial flush mode, (f) to provide a flush mechanism which is easily installed in new and existing toilets, simple to use and reliable in operation.

Further objects and advantages will become apparent from a consideration of the ensuing description and drawings.

BRIEF DESCRIPTION OF THE DRAWINGS

In the drawings, closely related figures have the same number but different alphabetic suffixes.

DESCRIPTION OF THE PREFERRED EMBODIMENTS

A typical embodiment of the present invention is shown in FIGS. 1 to 7 as installed in a conventional toilet tank. The conventional ballcock float and water inlet valve are omitted for clarity, as they are not inventive subject matter.

Figure 4:
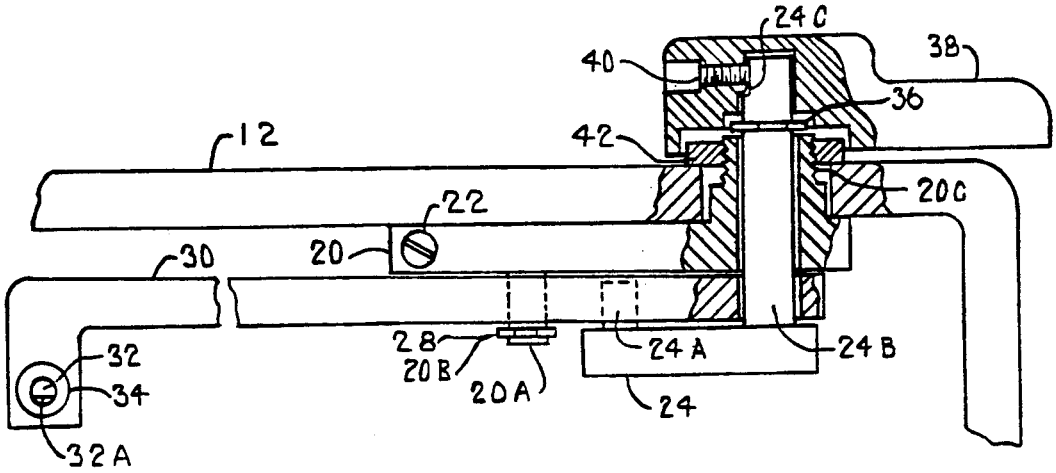
FIG. 4 is a plan view, partly in section, of the construction shown in FIG. 1.
Figure 5:
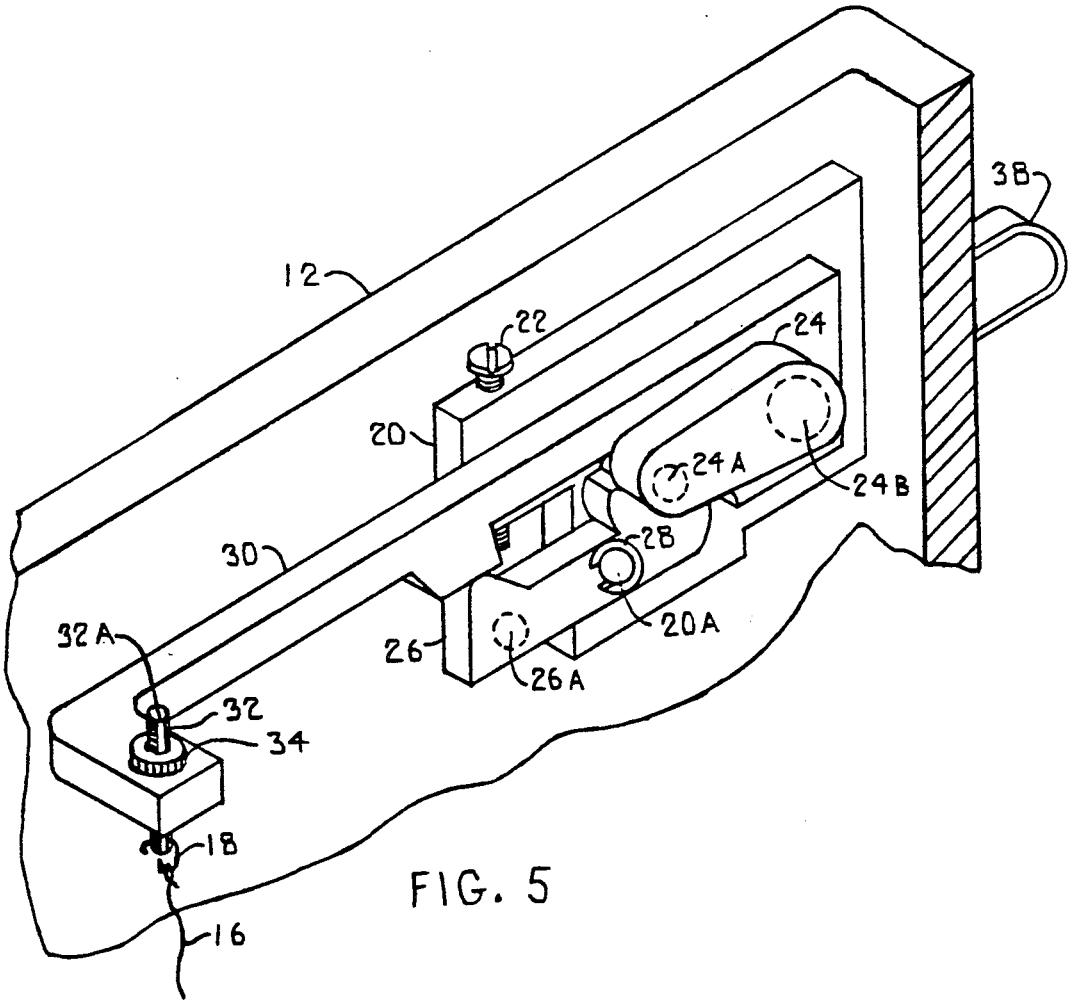
FIG. 5 is an isometric view of the construction shown in FIG. 4.
Figures 6, 7:
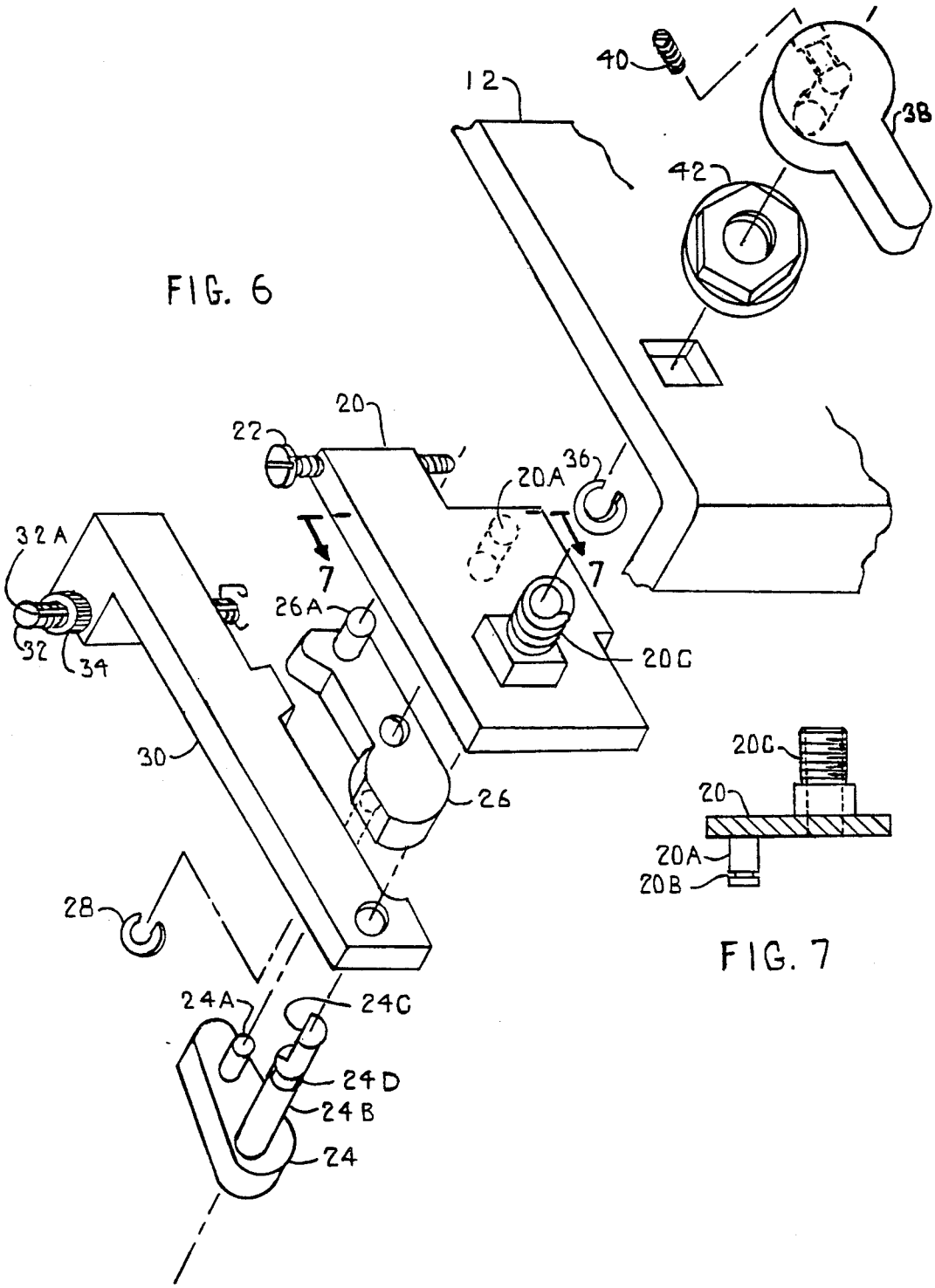
FIG. 6 is an isometric exploded view of all parts of this invention as they relate to a conventional toilet tank.
FIG. 7 is a sectional view as seen at line 7—7 in FIG. 6.

As shown in FIGS. 4 and 5, base plate 20 is fixedly attached to the interior wall of toilet tank 12 with hex nut 42 tightened on threaded boss 20*c*.

Shaft 24*b*, integral with actuating lever 24 is mounted rotatably through the hole in the right end of flush valve lift arm 30 and is rotatably mounted through the hole in base plate 20. Retaining washer 36 assembled into groove 24*d* and on shaft 24*b* which secures lever 24 and lift arm 30 in a freely rotatable position.

Flush control handle 38 is fixedly attached to the end of shaft 24*b*. A flat in the hole of handle 38 is mated to a flat 24*c* at the end of shaft 24*b*. The handle is further secured by set screw 40.

A double cam 26 is mounted freely rotatable on pivot pin 20*a*, which extends integrally from a side of base plate 20, and is secured in position by retaining washer 28 assembled into groove 20*b* in pin 20*a*.

Pin 24*a*, integral to and extending from the same side of lever 24 as is shaft 24*b*, is positioned in contact with the bottom edge of lift arm 30 and with the top edge at the right end of cam 26. The top edge at the left end of cam 26 is in contact with the bottom edge of lift arm 30.

Figure 3:
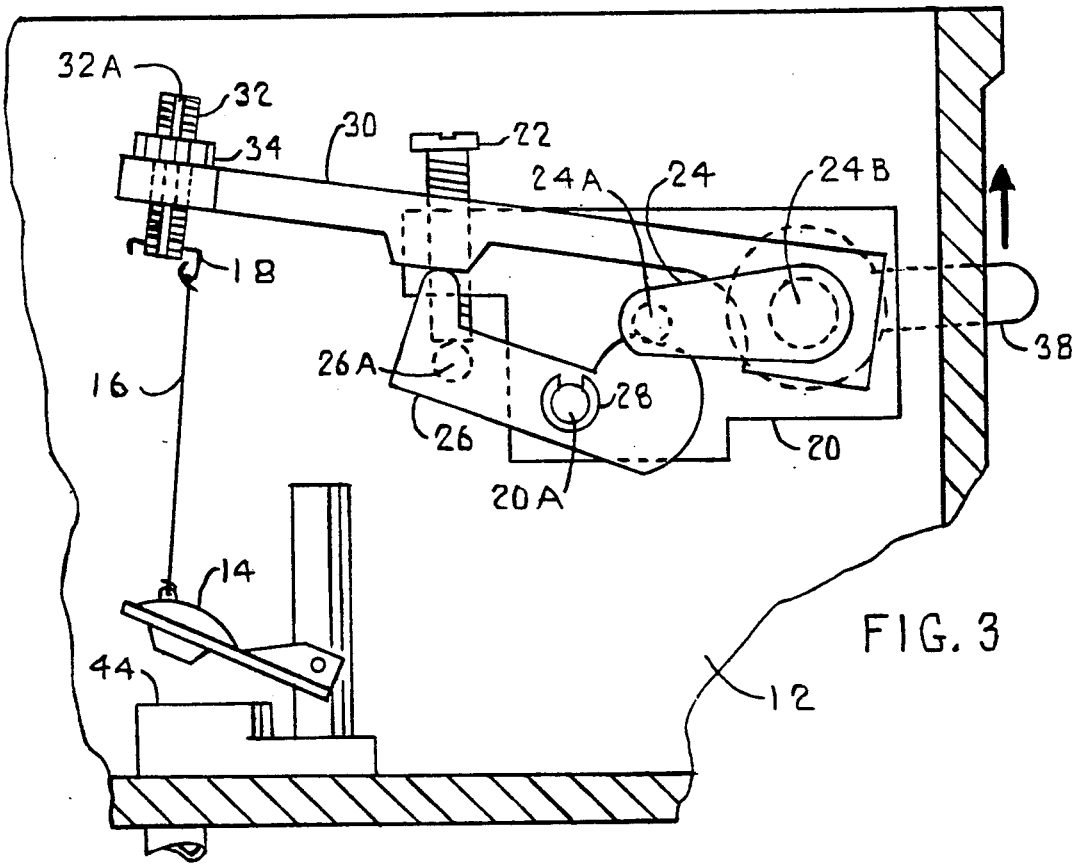
FIG. 3 is a view similar to FIG. 2 but showing the flush valve partially opened in the partial flush mode.

As shown in FIG. 3, stop pin 26*a*, integral to and extending from a side of cam 26, comes into contact with the bottom end of adjustable stop screw 22 limiting upward movement of cam 26 and lift arm 30 during the partial flush mode.

Stop screw 22 is adjusted, at the initial installation of this mechanism, to obtain the proper amount of flush valve 14 opening for the partial flush mode. Further adjustments of stop screw 22 would normally not be required.

Adjusting screw 32 has a longitudinal flat 32*a* and is slidably mounted through a smooth vertical hole in the left end of lift arm 30. Flat 32*a* is mated with a matching vertical flat in the lift arm 30 hole. This combination allows vertical movement but not rotational movement of screw 32. Threaded collar 34 provides vertical adjustment of screw 32. Chain 16 is attached to chain 32. Threaded collar 34 provides vertical adjustment of screw 32. Chain 16 is attached to chain hook 18, which is attached to the bottom end of screw 32. The other end of chain 16 is attached to flush valve 14. Adjusting collar 34 raises or lowers screw 32 to obtain the proper amount of slack in chain 16 while valve 14 is in the closed position. Anti-rotation of screw 32 prevents chain 16 from twisting during this adjustment, which is done at the initial installation of this mechanism.

To make installation by the user of this dual flush mechanism as easy as possible, all parts, except hex nut 42 and flush control handle 38, would be assembled as a sub-assembly at the manufacturing facility.

OPERATION

Figure 1:
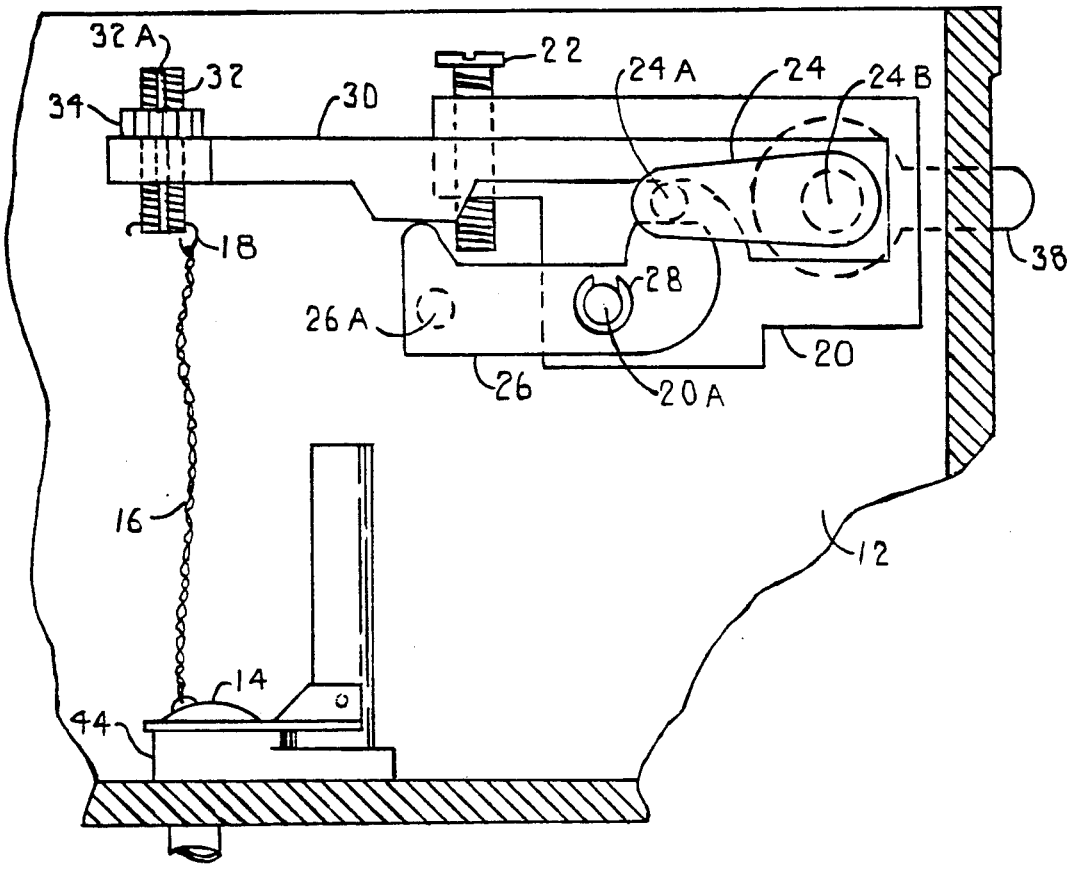
FIG. 1 is a side elevation of a conventional toilet tank, partly in section, with the dual flush mechanism installed. The flapper type flush valve is fully closed ready for flushing.

As shown in FIG. 1, flush valve 14 is in the closed position on water outlet 44. Chain 16 has been adjusted to allow slack so that water weight keeps valve 14 securely closed. Tank 12 is filled with water and is ready for the next flush selection.

Figure 2:
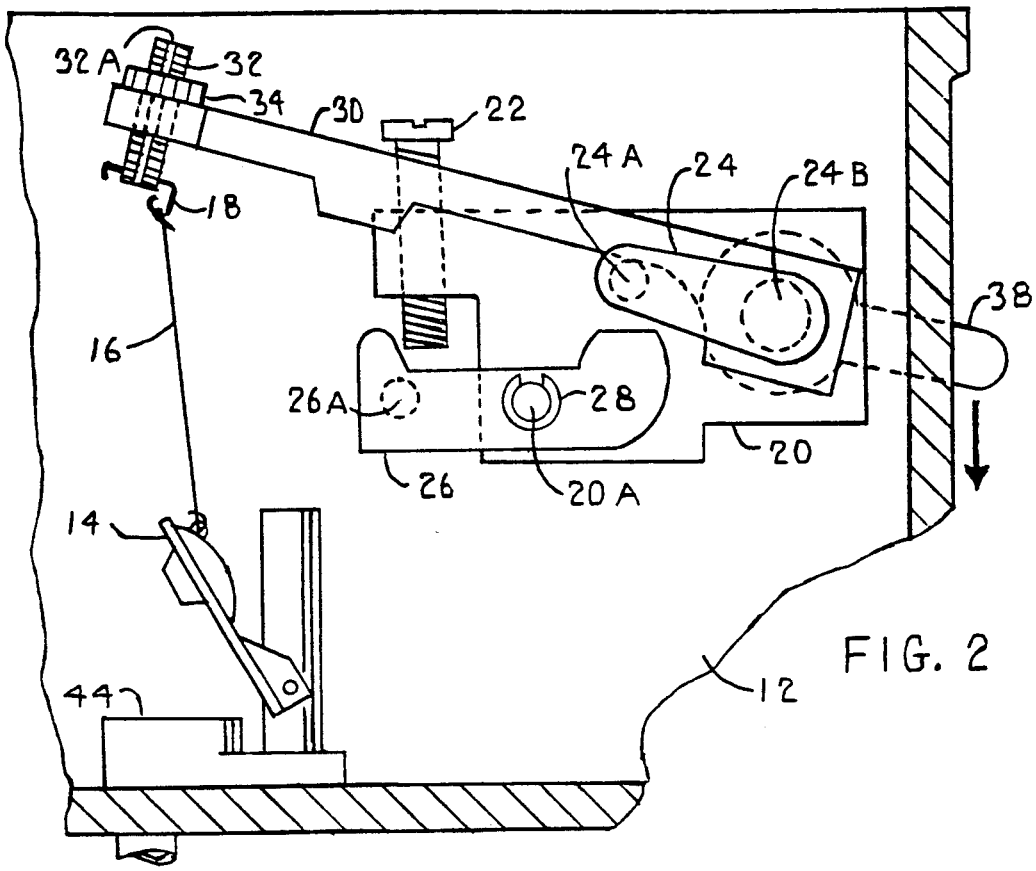
FIG. 2 is a view similar to FIG. 1 but showing the flush valve fully opened in the full flush mode.

As shown in FIG. 2, a conventional full flush of water is obtained by pushing down flush control handle 38, causing actuating lever 24 to rotate upward. Pin 24*a* engages and raises flush valve lift arm 30, which freely rotates on shaft 24*b*. Chain 16, being pulled upward, lifts valve 14 to a fully opened position to let a full discharge of water egress through outlet 44. Valve 14, no longer being kept open by the flow of water, returns to the closed position on outlet 44. Toilet tank 12 then refills with water by the action of the conventional ball float and water inlet valve.

As shown in FIG. 3, a partial flush of water, for liquid waste, is obtained by lifting upwards flush control handle 38, causing actuating lever 24 to rotate downwards. Pin 24*a* pushes down the top right end of double cam 26, which is mounted on pivot pin 20*a*. The top left end of double cam 26 pivots upwards, raising flush valve left arm 30, which pulls up chain 16, lifting flush valve 14 to a partial open position as limited by stop pin 26*a* contacting stop screw 22.

In this partial flush mode, the user can lift up then immediately release flush control handle 38, which in turn opens then immediately closes flush valve 14, allowing a minimum amount of water to be flushed as determined by the setting of adjustable stop screw 22. Or the user can hold flush control handle 38 against the stop position to keep flush valve 14 open for a few seconds longer, until obtaining the desired clearing of the various degrees of liquid waste.

A lighter colored liquid waste would require less flushing water than a darker liquid waste. The user can control the amount of water required, and not be limited to a preset fixed amount of water for the partial flush mode.

Releasing flush control handle 38 allows flush valve 14 to immediately close by the weight of the water remaining in tank 12. Water is then refilled by the action of the conventional ball type float and water inlet valve.

Although the above description contains many specificities, these should not be construed as limiting the scope of the invention, but as merely providing illustrations of some of the presently preferred embodiments of this invention. It will be apparent that various omissions, changes and substitutions may be made in form and construction of the details, of the mechanism illustrated, without departing from the spirit and scope of the invention.

I claim:

1. A dual mode flush mechanism selectively operable in a full flush or partial flush mode for use with toilets having a tank assembly including a tank having a through-hole for receiving said mechanism and a flush valve operable by a flexible member, the dual mode flush mechanism comprising:

a base plate with attachment means adapted to be connected to the interior wall of the tank;

a flush valve lift arm having a first end and a second end, said first end of said flush valve lift arm having means for being pivotally mounted to said base plate and said second end of said flush valve lift arm having a through-hole with attachment means for receiving said flexible member therein;

a double cam member having first and second ends, said double cam comprising means intermediate said first and second ends of said cam member for being pivotally attached to said base plate, said first end of said cam comprising means for abutting a bottom edge of said lift arm;

an actuating lever comprising a first end and a second end, said first end of said actuating lever comprising means for being rotatably mounted to said base plate, and said second end of said actuating lever comprising means for abutting a bottom edge of said flush valve lift arm and a top edge of said second end of said cam, said lift arm, said cam member, and said actuating lever being mounted on said base plate such that said abutting means of said actuating lever contacts said bottom edge of said lift arm when rotated in a first direction and contacts said top edge of said second end of said cam member when rotated in an opposite direction to rotate said cam member causing said first end of said cam member to contact a bottom edge of said lift arm;

and a flush control handle adapted to be disposed externally of said tank and further comprising means for rotatably attaching said handle to said actuating lever through said through-hole of said tank to rotate said lever for a full or partial flush.

2. The mechanism of claim 1 wherein said base plate further comprises a horizontal extension parallel to said base plate which forms a step along an upper edge of said base plate, said extension further comprising an adjustable screw member vertically threaded through said extension wherein said abutting means on said first end of said cam further abuts said screw member after abutting said bottom edge of said lift arm thereby limiting movement of said first end of said cam when said actuating lever is rotated in said opposite direction.

3. The mechanism of claim 1 wherein said through-hole of said lift arm comprises a vertically disposed non-threaded through-hole consisting of a first diameter and a vertically extending flat edge along the inner diameter of said through-hole of said lift arm.

4. The mechanism of claim 3 wherein said attachment means for said flexible member consists of a threaded screw member having first and second ends, said screw member having a second diameter smaller than said first diameter to allow a slidable fitting in said through-hole of said lift arm and a vertically extending flat edge along the outer diameter of said screw member which mates with said flat edge of said through-hole of said lift arm to prevent rotation of said screw member therein, wherein said first end of said screw member extends below the bottom edge of said lift arm and is provided with hook means to which said flexible member is attached, and said second end of said screw member extends above the top edge of said lift arm and is further provided with a threaded collar which mates with the threaded screw member to provide vertical adjustment means of said screw member to obtain a proper amount of slack in said flexible member when the flush valve is in a closed position.

5. The mechanism of claim 4 wherein said flexible member is a chain.

6. The mechanism of claim 1 wherein said first end of said lift arm and said first end of said actuating lever are both mounted to said base plate at a first location on said base plate, said base plate attachment means includes a male threaded boss having a first end within said tank and a second end exterior said tank, said first end of said boss adapted to be coaxially mounted through said hole in said tank and through a hole in said base plate at said first location, said male threaded boss further comprising a nut mounted on said second end of said boss to secure said boss to an exterior wall of said tank to fixedly attach said base plate to an interior wall of the tank, said boss further having a bore hole extending lengthwise through and concentric to said boss.

7. The mechanism of claim 6 wherein said actuating lever further consists of a shaft having first and second ends, said first end of said shaft is fixedly attached to said first end of said actuating lever, and said second end of said shaft extends through a hole in said first end of said flush valve lift arm and through and concentric to said bore hole in said boss and terminates in a fixed connection to said flush control handle wherein said first end of said lift arm is freely pivoted about said shaft and rotation of said handle causes rotation of said actuating lever and shaft.

8. The mechanism of claim 7 wherein manual downward movement of said flush control handle causes upward rotation of said actuating lever in said first direction thereby causing said abutting means on said second end of said actuating lever to abut said bottom edge of said lift arm to rotate said lift arm in said first direction and to open said flap valve for a full flush.

9. The mechanism of claim 7 wherein manual upward movement of said flush control handle causes downward rotation of said actuating lever in said opposite direction thereby causing said abutting means on said second end of said actuating lever to abut said second end of said cam member causing said first end of said cam member to rotate upwards and to contact said bottom edge of said lift arm to cause rotation of said lift arm in said first direction, wherein rotation of said first end of said cam is limited by an adjustable stop means connected to said base plate which abuts said abutting means on said first end of said cam thereby limiting rotation of said lift arm and effecting a partial flush mode.

* * * * *